US011324293B2

(12) United States Patent
Kim et al.

(10) Patent No.: US 11,324,293 B2
(45) Date of Patent: May 10, 2022

(54) SUITCASE

(71) Applicants: Dowan Kim, Seoul (KR); Stephanie Kim, Seoul (KR); Joshua Yujun Kim, Seoul (KR)

(72) Inventors: Dowan Kim, Seoul (KR); Stephanie Kim, Seoul (KR); Joshua Yujun Kim, Seoul (KR)

( * ) Notice: Subject to any disclaimer, the term of this patent is extended or adjusted under 35 U.S.C. 154(b) by 329 days.

(21) Appl. No.: 16/564,025

(22) Filed: Sep. 9, 2019

(65) Prior Publication Data

US 2020/0000192 A1 Jan. 2, 2020

Related U.S. Application Data

(63) Continuation of application No. PCT/KR2018/003225, filed on Mar. 20, 2018.

(30) Foreign Application Priority Data

Mar. 20, 2017 (KR) ..... 10-2017-0034798

(51) Int. Cl.
*A45C 5/14* (2006.01)
*A45C 5/03* (2006.01)
(Continued)

(52) U.S. Cl.
CPC ..... *A45C 5/14* (2013.01); *A45C 5/03* (2013.01); *A45C 13/04* (2013.01); *A45C 13/262* (2013.01);
(Continued)

(58) Field of Classification Search
CPC ..... A45C 5/14; B62B 1/04
(Continued)

(56) References Cited

U.S. PATENT DOCUMENTS 1,212,139 A * 1/1917 Graves ..... A45C 13/03 190/13 R
5,862,572 A * 1/1999 Lin ..... A45C 13/262 16/405
(Continued)

FOREIGN PATENT DOCUMENTS

JP 2010188861 A 9/2010
JP 2012135435 A 7/2012
(Continued)

OTHER PUBLICATIONS

International Search Report for PCT/KR2018/003225 of Jul. 3, 2018.

*Primary Examiner* — John K Fristoe, Jr.
*Assistant Examiner* — Justin Caudill
(74) *Attorney, Agent, or Firm* — Dinsmore & Shohl LLP; Yongsok Choi, Esq.

(57) ABSTRACT

A travel bag is provided. The travel bag comprising: a frame having at least three wheels attached thereto, each of the wheels being configured to be contact to a ground; a case being configured to have an empty space to receive objects and also being configured to be disposed on the frame; and a pivot axis being located on or above the frame, the pivot axis being defined by two contact points or a contact line connecting the case and the frame. The case disposed on the frame is allowed to pivot on the pivot axis to draw a trajectory of an arc or a circle. All of the wheels are configured to be maintained as being continuously contact to the ground, regardless of the case's pivoting around the pivot axis.

7 Claims, 13 Drawing Sheets

(51) Int. Cl.
*A45C 13/04* (2006.01)
*A45C 13/26* (2006.01)

(52) U.S. Cl.
CPC .. *A45C 2005/148* (2013.01); *A45C 2013/267* (2013.01)

(58) Field of Classification Search
USPC ..... 280/24.2, 47.24, 38
See application file for complete search history.

(56) References Cited

U.S. PATENT DOCUMENTS 5,875,520 A * 3/1999 Chang ..... A45C 13/262 16/405
5,947,491 A * 9/1999 Meier ..... B62B 1/002 280/47.2
5,950,779 A * 9/1999 Miyoshi ..... A45C 5/14 190/18 A
6,470,529 B1 * 10/2002 Chang ..... A45C 13/262 16/113.1
9,849,723 B2 * 12/2017 LaFever ..... B60B 33/066
2003/0085088 A1 5/2003 Wu
2007/0119661 A1 * 5/2007 Chang ..... B60B 33/0039 188/1.12
2015/0145223 A1 * 5/2015 Gregory ..... A45C 5/146 280/35
2015/0245694 A1 * 9/2015 Banoun ..... A45C 5/145 190/18 A

FOREIGN PATENT DOCUMENTS

KR 20050088056 A 9/2005
KR 20100003275 U 3/2010

* cited by examiner

SUITCASE

CROSS-REFERENCE TO RELATED APPLICATIONS

This application is a continuation of PCT/KR2018/003225 filed on Mar. 20, 2018 which claims priority to Korean Patent Application No. 10-2017-0034798 filed on Mar. 20, 2017, the entire contents of which are herein incorporated by reference.

BACKGROUND

1. Technical Field

Exemplary embodiments of the present inventive concept relate to a travel bag. More particularly, exemplary embodiments of the present inventive concept relate to a travel bag having enhanced stability, steerability and user convenience.

2. Description of the Related Art

A travel bag, which is used to receive and protect objects, generally includes wheels and a handle. Generally, the travel bag may have a rectangular shape to maximize a storage efficiency and for a convenience of a shipment. For example, an international standard for the travel bag to be carried into airplane cabins, requires that the travel bag should have the rectangular shape having a length, a width and a height. The travel bag may have plural wheels (e.g., four wheels each of which is at each corner of a rectangular-shaped bottom surface, but not limited thereto). The wheels are placed under a bottom surface of the bag that is generally defined by the length and the width and usually positioned to be close and parallel to a ground plane. In consideration of a position of a user's hand, the height of the travel bag, which is perpendicular to the bottom surface, may be designed to be longer than the length and the width. The travel bag generally also has a handle positioned along a direction of the height. Recently, wheels pivotable 360 degrees around an axis perpendicular to the ground are often adopted for the travel bag (as shown in FIG. 8).

If a user of the travel bag is right-handed, he or she may place the travel bag in his or her right front position (or in his or her left front position if the user being left-handed) to have its height be perpendicular to the ground and all of its wheels be contact to the ground (hereinafter, "a vertical status"). Then, if the user wants to move the travel bag in a desired direction, the user may apply a horizontal force to the handle of the travel bag. In this case (i.e., when the travel bag is moved in the vertical status, without being inclined), since the handle is usually disposed in an uppermost position along the height direction, the travel bag may be shaken back and forth along its moving direction and may be fallen down by an obstacle on the ground due to an unbalanced moment of force generated by a weight of the travel bag and the applied horizontal force.

Thus, if the ground is uneven or the user wants to move the bag fast, it may be better for the user to move the bag in an inclined status, in which the travel bag and its handle are inclined towards the user so that only some of its wheels (i.e., only the wheels disposed directly under the handle) are contact to the ground. In this case, a possibility of falling down of the moving travel bag may be somewhat reduced.

However, even in the inclined status, for example, when the ground is uneven, an unbalanced moment due to different levels of the wheels on the uneven ground may be still generated in a direction perpendicular to the moving direction of the travel bag so that the travel bag still may be shaken from side to side. In particular, when the user moves the travel bag fast on the uneven ground, the travel bag may be easily flipped or fallen down due to the unbalanced moment. In addition, if the user changes the moving direction while moving the travel bag fast, the travel bag may be more easily flipped or fallen down due to the unbalanced moment generated by a centrifugal force in the direction perpendicular to the moving direction of the travel bag.

Another problem may occur when the travel bag is moved in the inclined status. It is that although the wheels of the travel bag are originally designed to be rotatable 360 degrees around an axis perpendicular to the ground, in the inclined status, the axis of each wheel being contact to the ground (e.g., each of two wheels disposed directly under the handle) may be fixed so that the wheels being contact to the ground may not freely rotate in various directions. Thus, even though an external force is applied in a direction (e.g. an X axis direction) perpendicular to the moving direction (e.g. an Y axis direction), the wheels on the ground may not rotate in various directions and a steerability of the travel bag may be limited due to a frictional force. It may be a serious constraint for a user moving the travel bag.

In a narrow aisle, if the user disposes the travel bag in front of the user in the vertical status and moves the bag by pushing it with the horizontal force, the travel bag may be bumped into the user's feet. Generally, a width of the aisle is too narrow for the user to dispose and move the travel bag in a lateral side of the user. If the user disposes the travel bag in his or her rear side and pulls the travel bag in the inclined status along the narrow aisle, as discussed above, rotation and a moving direction of each wheel may be limited to deteriorate the steerability of the travel bag. In this case, the travel bag may be bumped into seats disposed in both sides of the aisle, which prevents the user from moving the bag forward. Eventually, the user should lift the heavy travel bag up to move it in the narrow aisle so that the user may experience serious inconvenience.

In addition, when the user pulls the travel bag across a step between a sidewalk and a driveway or a step between a sidewalk and a parking lot, a rear surface of the travel bag may be scratched or damaged. Thus, in this situation, the user also should lift up the travel bag to move it.

Furthermore, when the user moves the travel bag in the inclined status, whole weights of the travel bag and the objects included in the travel bag may be loaded onto only two wheels (instead of four entire wheels) which are contact to the ground and onto a hand of the user. When the user moves the travel bag in the inclined status for a long time and thus, a force and a work in a direction of gravity are generated in the inclined status (unlike in the vertical status), the user may suffer from pains on his or her hand, elbow and shoulder.

SUMMARY

Exemplary embodiments of the present inventive concept provide a travel bag capable of being inclined in various angles with respect to a ground, while maintaining a state in which the bag is supported by all of wheels regardless of an inclined angle of the travel bag. Exemplary embodiments of the present inventive concept provide a travel bag having wheels rotatable 360 degrees around an axis perpendicular to the ground even in an inclined status, which has enhanced mobility and reduces loads applied on the user's hand and shoulder.

According to one aspect of the present inventive concept provides a travel bag comprising: a frame having at least three wheels attached thereto, each of the wheels being configured to be contact to a ground; a case being configured to have an empty space to receive objects and also being configured to be disposed on the frame; and a pivot axis being located on or above the frame, the pivot axis being defined by two contact points or a contact line connecting the case and the frame. The case disposed on the frame is allowed to pivot on the pivot axis to draw a trajectory of an arc or a circle. All of the wheels are configured to be maintained as being continuously contact to the ground, regardless of the case's pivoting around the pivot axis.

According to embodiments of the present inventive concept, the case has a height direction that is disposed perpendicular to the ground when the case is in a vertical status, and the height direction is allowed to be inclined according to the case's pivoting around the pivot axis so that an angle between the height direction and a plane defined by the wheels is allowed to vary. The travel bag further comprises an angle maintaining unit configured to maintain the varied angle between the height direction and the plane, after the case's pivoting around the pivot axis.

According to embodiments of the present inventive concept, the angle maintaining unit has a shape of an arc or a circle whose center is the rotating axis, and the angle maintaining unit has a plurality of recesses or holes formed thereon, each of the recesses having a shape of a part of hollow hemisphere and each of the holes having a shape of hollow cylinder. The travel bag further comprises an adjusting unit, comprising: a protrusion including a tip having a portion of a part of convex hemisphere or a cylinder, the tip being configured to be inserted into a recess or a hole among the plurality of recesses or holes according to the case's pivoting around the pivot axis; and a contact portion configured to be operated either to maintain the tip as being inserted into the recess or hole or to push the tip to be slid out in a direction away from the recess or hole.

According to embodiments of the present inventive concept, the protrusion is disposed at the case, and the angle maintaining unit is coupled to the frame.

According to embodiments of the present inventive concept, the protrusion is disposed at the frame, and the angle maintaining unit is coupled to the case.

According to embodiments of the present inventive concept, the adjusting unit further comprises an elastic member configured to press the protrusion toward the angle maintaining unit.

According to embodiments of the present inventive concept, the protrusion includes a slope surface that is inclined with respect to a direction of a pressure of the elastic member, and the adjusting unit comprises: an operating portion configured to be operated by a user; and an elastic part configured to push the operating portion in a direction that makes the contact portion be located apart from the slope surface of the protrusion. When the user applies a force to the operating portion, the elastic part is pressed so that the contact portion pushes the slope surface of the protrusion.

According to embodiments of the present inventive concept, the adjusting unit further comprises a connecting portion connecting the operating portion and the contact portion, and when the user applies a force to the operating portion downwardly, at least a part of the force is transferred to the connecting portion to cause a leverage effect that makes the contact portion push the slope surface of the protrusion.

According to embodiments of the present inventive concept, the travel bag further comprises a brake disposed at the frame and configured to prevent a rolling of at least one of the wheels. The brake comprises: an elastic element coupled to the frame; a foothold configured to be pressed by the elastic element in an upper direction; and a friction pad configured to make contact to the at least one wheel when the foothold is pressed in a lower direction.

According to embodiments of the present inventive concept, the travel bag further comprises a friction pad configured to make contact to at least one of the wheels to prevent a rolling of the at least one wheel. When the user applies a force to the foothold, the friction pad moves to make contact to the at least one wheel.

According to the exemplary embodiments of the present inventive concept, the case includes a pair of sides facing each other, and an openable part is disposed on each of the sides.

According to the exemplary embodiments of the present inventive concept, the travel bag may be continuously supported by all of its wheels, regardless of whether it is in the vertical status or the inclined status, with no auxiliary additional supporting element. The travel bag may be inclined in various angles with respect to a ground, regardless of whether it moves or stops. All of the wheels of the travel bag can be contact to the ground even in the inclined status and are rotatable in 360 degrees on the ground so that the steerability of the travel bag in the inclined status may be enhanced. Furthermore, even when the travel bag encounters any obstacle or step on the ground while moving fast in the inclined status, the user may make the travel bag easily pass the obstacle or step, without lifting it, by simply adjusting the inclined angle of the travel bag to cause a leverage effect. Thus, the stability of the travel bag may be enhanced.

According to the exemplary embodiments of the present inventive concept, the weight of the travel bag may not be applied to the hand of the user even in the inclined status, and thus, the user's hand, wrist, elbow and shoulder do not need to suffer from pains and damages.

According to the exemplary embodiments of the present inventive concept, the inclined angle of the travel bag may be adjusted to be large enough for a direction of the height of the travel bag (a case of the travel bag) to become to be parallel with the ground (i.e., the case of the bag being disposed along a horizontal direction and the bottom surface of the bag being disposed to be perpendicular to the ground), while all of the wheels being contact to the ground. Thus, to take any object out from the travel bag, the user can make the case of the bag be parallel with the ground (and apart from the ground with some distance), instead of putting the travel bag on the dirty ground and squatting down or bending a waist to find the object, and can easily take the desired object out from the bag, without dropping any other objects from the travel bag.

DETAILED DESCRIPTION

Hereinafter, the travel bag according to exemplary embodiments of a present inventive concept will be explained in detail with reference to the accompanying drawings.

The travel bag of the present inventive concept may be continuously supported by all of its wheels. The travel bag may be inclined in various angles with respect to a ground when it moves or stops. All of the wheels of the travel bag make contact to the ground even in the inclined status and are rotatable 360 degrees on the ground. Thus, when the user moves the travel bag by pushing or pulling it, the steerability of the travel bag may be enhanced. Furthermore, when the user encounters any obstacle or steps on the ground while moving the travel bag by pushing or pulling it, the user may make the travel bag easily pass the obstacle or step without lifting the heavy bag, simply by adjusting the inclined angle of the travel bag.

Figure 1:
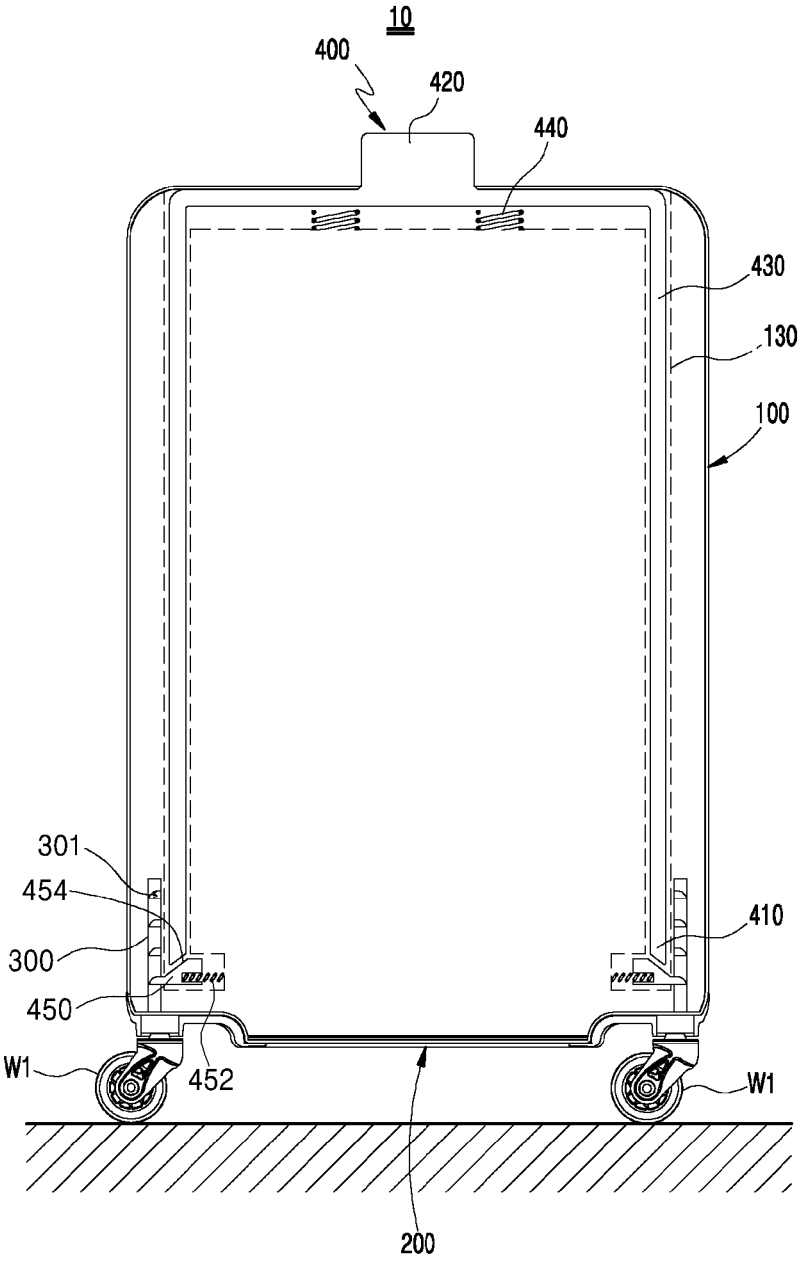
FIG. 1 is a transparent front view illustrating a travel bag according to a first exemplary embodiment of the present inventive concept.
Figure 2:
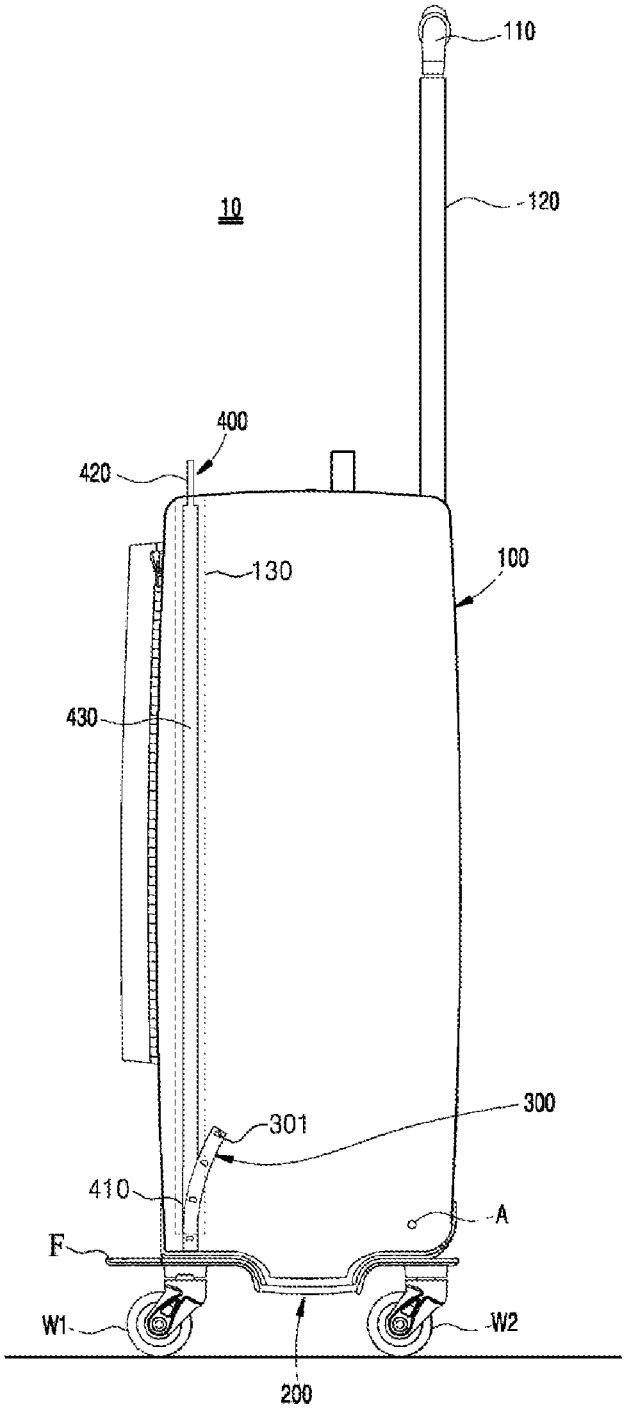
FIG. 2 is a transparent side view illustrating the travel bag of FIG. 1.
Figure 3:
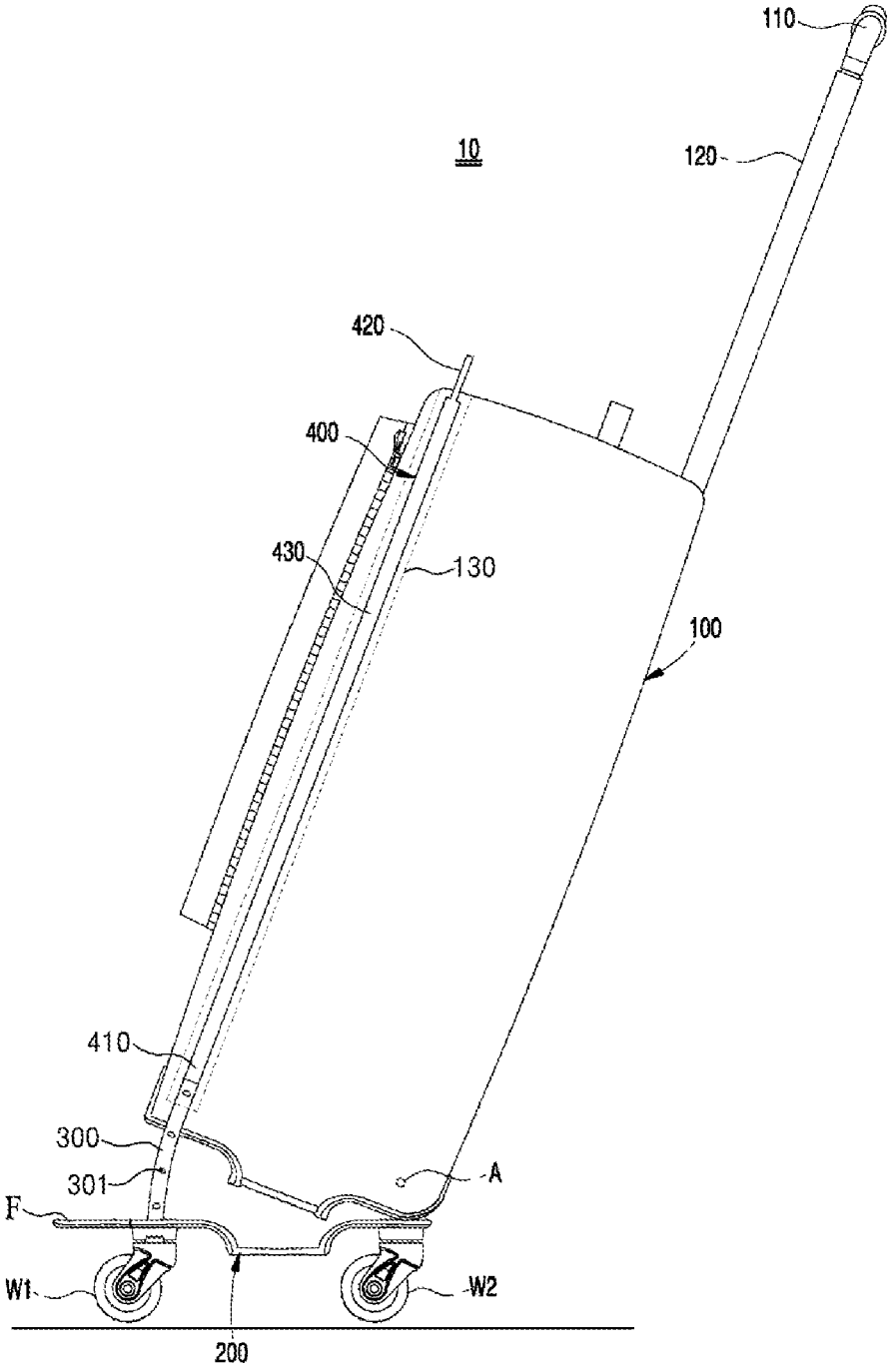
FIG. 3 is a transparent side view illustrating the travel bag of FIG. 1.
Figure 4:
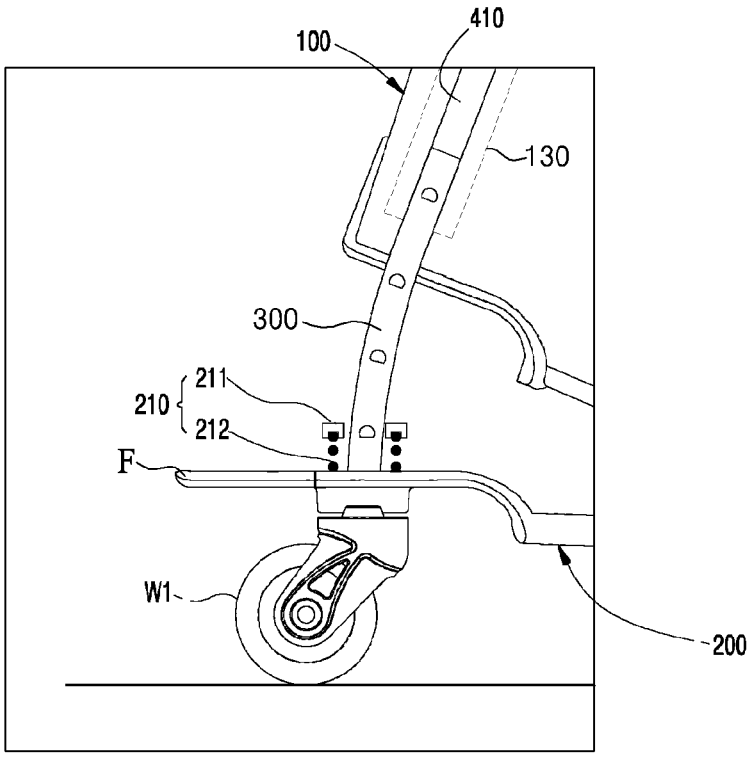
FIG. 4 is an enlarged cross-sectional view illustrating a buffer part of the travel bag of FIG. 1.

FIG. 1 is a transparent front view illustrating a travel bag according to a first exemplary embodiment of the present inventive concept. FIGS. 2 and 3 are transparent side views illustrating the travel bag of FIG. 1 (FIG. 2 illustrates a vertical status of the travel bag and FIG. 3 illustrates an inclined status of the travel bag). FIG. 4 is an enlarged cross-sectional view illustrating a buffer part of the travel bag of FIG. 1, in which a portion of a case of the travel bag is apart from its frame (i.e., the inclined status of the travel bag).

Referring to FIGS. 1 to 4, according to the exemplary embodiment of the present inventive concept, all the wheels of the travel bag 10 may be always contact to the ground, regardless of whether the travel bag 10 is moving or stopped. The travel bag 10 can be continuously supported by all of its wheels, with no help of any auxiliary wheel. Each of the wheels being contact to the ground may be rotatable in various directions even in the inclined status of the travel bag 10. The travel bag 10 may include a case 100, a frame 200, an angle maintaining unit 300, and an adjusting unit 400.

The case 100 may be a hard case or a soft case. The case 100 may have a generally rectangular parallelepiped shape. A handle 110 may be disposed at an upper portion of the case 100 so that a user may pull the case 100 using the handle 110.

The handle 110 may be fixed to the case 100. In contrast, the handle 110 may be designed to be slid in and out for a user convenience as shown in FIG. 2. The handle 110 of the travel bag 10 may be formed on an edge portion of an upper surface of the case 100, instead of a central portion thereof.

When the user pulls up the handle 110 disposed at the upper portion of the case 100, two bars 120 connected to the handle 110 may be slid out so that a position of the handle 110 may get higher. Herein, two parallel bars 120 may extend from the upper portion of the case 100 and may be connected to each other by the handle 110. The structure of the handle 110 which may be slid in and out may be a conventional structure so that a detailed explanation regarding the structure of the handle 110 may be omitted.

As shown in FIGS. 2 and 3, a frame 200 may be a kind of stand to support the case 100. An angle between the height direction of the case 100 and the ground may be adjusted. A pair of first wheels W1 and a pair of second wheels W2 may be disposed under a back surface of the frame 200. The first wheels W1 and the second wheels W2 may roll on the ground. In the exemplary embodiment, the pair of first wheels W1 may be disposed respectively at both ends of a front portion (i.e., one side, which may be farther from the handle 110) of the back surface of the frame 200. The pair of second wheels W2 may be disposed respectively at both ends of a rear portion (i.e., an opposite side, which may be directly under to the handle 110) of the back surface of the frame 200 to face the pair of first wheels W1. In an alternative exemplary embodiment, a single wheel W1 or W2, instead of the pair of the wheels W1 or W2, may be disposed at a center of each side of the back surface of the frame 200.

The case 100 may be mounted on the frame 200. A weight of the case 100 may be transmitted to the ground through the first wheels W1 and the second wheels W2 formed under the frame 200. The case 100 may be coupled to the frame 200 to be pivotable on a rotating axis A, which may be disposed over the second wheels W2, but not limited thereto. Although not specifically shown in the drawings, in an exemplary embodiment, the case 100 may pivot on the rotating axis A such that a direction of a height of the case 100 is inclined with respect to a Z axis direction, which is perpendicular to a ground.

Referring to FIGS. 2 to 4, a foot plate F may be coupled to the frame 200 over the first wheels W1. While pivoting the case 100 around the axis A so that an angle between the case 100 and the frame 200 may be increased, the user may step on the foot plate F to prevent the frame 200 from rotating or moving along with the case 100.

As shown in FIG. 3, in the travel bag 10 according to the present exemplary embodiment, the case 100 may be coupled to the frame 200 pivotably around the rotating axis A and the first wheels W1 and the second wheels W2 may be maintained to be contact to the ground even when the case 100 is inclined. Thus, the travel bag 10 according to the present exemplary embodiment may solve the above-discussed problems of the conventional travel bag.

As shown in FIGS. 1 to 3, the angle maintaining units 300 may be used to maintain an increased angle between the height direction of the case 100 and the ground after the case 100 is rotated.

The angle maintaining units 300 may include a plurality of holes 301. Each of the angle maintaining units 300 may be respectively disposed and coupled to the frame 200 over each first wheel W1. In one embodiment, the angle maintaining units 300 may have a shape of an arc of a circle whose center is the rotating axis A. Along a longitudinal direction of each angle maintaining unit 300, the plurality of the holes 301 may be formed spaced apart from one another. In an exemplary embodiment, the angle maintaining units 300 may be coupled to the frame 200 to be able to slide into or slide out from a certain space of the case 100, which is prepared in advance for accommodating the angle maintaining units 300 according to the rotation of the case 100. Namely, the angle maintaining units 300 may be received in the certain space of the case 100 so that the angle maintaining unit 300 may not be entirely or partially outwardly exposed. However, for convenience of explanation, in FIGS. 1 to 4, the entire angle maintaining unit 300, i.e., including a portion not outwardly exposed within the certain space, is illustrated.

For example, the hole 301 may be a recess space having a shape of a portion of hollow hemisphere (e.g. a half of the hemisphere), which is open towards the case 100 (i.e., in a direction toward a protrusion of an adjusting unit 400, which is to be discussed below). A curved portion of the hole 301 may be disposed at an upper position, but the present inventive concept is not limited thereto. The shape of the recess space of the hole 301 may correspond to a shape of an end portion of the protrusion 450 of the adjusting unit 400 so that the end portion of the protrusion 450 may be inserted and fit into the hole 301. When the user applies a turning force to the case 100 to change from the status of FIG. 2 to the status of FIG. 3, the end portion of the protrusion 450 is slid out from the recess space of the hole 301 so that the case 100 may be rotated to the status of FIG. 3. In FIGS. 2 to 4, the protrusions 450 may be covered and hidden by the angle maintaining unit 300.

The protrusion 450 may include the end portion to be inserted into or ejected from the hole 301. The protrusion 450 may be disposed within the case 100 (in particular, in a corresponding position of a mounting portion 130), with being pressed toward the angle maintaining unit 300 by an elastic member 452 attachedly disposed in the mounting portion 130. As shown in FIG. 1, in an exemplary embodiment, the protrusion 450 may include an slope surface 454 which is inclined along a direction pressed by the elastic member 452.

As shown in FIGS. 2 and 3, when the case 100 is pivoting around the rotating axis A, leaving the first and second wheels W1 and W2 contact onto the ground, a moving path of the protrusion 450 may form an arc of a circle whose center is the rotating axis A. Namely, when the turning force is applied, the protrusion 450, which has been inserted in the hole 301, may be ejected from the hole 301 and moves along the angle maintaining unit 300 to be inserted into another hole 301 among the plurality of holes 301. As the rotating angle around the rotating axis A increases, the protrusion 450 may be inserted in a hole 301 disposed farther from the frame 200.

As shown in FIG. 1, the adjusting unit 400 may include a contact portion 410, an operating portion 420, a connecting portion 430, an elastic part 440, the protrusion 450 and the elastic member 452. The contact portion 410 may be disposed adjacent to the protrusion 450. When the user applies a pressure, the contact portion 410 may make contact to the protrusion 450. The operating portion 420 may be disposed close to a hand of the user. The user may operate the adjusting unit 400 through the operating portion 420. For example, the user may apply the pressure to the adjusting unit 400 by the operating portion 420. The connecting portion 430 may connect the contact portion 410 and the operating portion 420.

When the user applies the pressure to the adjusting unit 400 through the operating portion 420, the pressure may be transmitted to the contact portion 410 through the connecting portion 430. By the operation (e.g. the applied pressure) of the user, the contact portion 410 may push the protrusion 450 in an outward direction from the hole 301 so that the protrusion 450 may be easily ejected from the hole 301. The contact portion 410 and the connecting portion 430 may form a bended bar shape having a shape of "∩" or "Π".

The mounting portion 130 may be formed within the case 100 (e.g. on a front inner surface of the case 100). The contact portion 410, a part of the operating portion 420, the connecting portion 430, the elastic part 440, the protrusion 450 and the elastic member 452 of the adjusting unit 400 may be disposed within the mounting portion 130. The mounting portion 130 (represented by dotted lines in FIGS. 1 to 4) may have a bended pipe shape having a shape of "∩" or "Π" to receive the contact portion 410 and the connecting portion 430. The mounting portion 130 may be a structural member or an empty space buried at an inner surface of the case 100.

The operating portion 420 may be protruded over an upper surface of the case 100 and may be operated by the user to make the contact portion 410 push an slope surface 454 of the protrusion 450. A lower portion of the operating portion 420 may be connected to the connecting portion 430 within the mounting portion 130. The connecting portion 430 connects the operating portion 420 and the contact portion 410 within the mounting portion 130.

The elastic part 440 may be disposed under the operating portion 420 within the mounting portion 130. The elastic part 440 applies a pressure upwardly to the operating portion 420 such that a distance between the contact portion 410 and the slope surface 454 of the protrusion 450 increases.

In FIG. 1, when the user pushes the operating portion 420 downwardly, the elastic part 440 may be pressed and the contact portion 410, the operating portion 420 and the connecting portion 430 may be also moved downwardly by the pressed distance of the elastic part 440.

When the user takes hand off from the operating portion 420, the elastic part 440 may extend and the contact portion 410, the operating portion 420 and the connecting portion 430 may be moved upwardly by an extended distance of the elastic part 440. The mounting portion 130 may include a space for allowing movement of the contact portion 410, the operating portion 420 and the connecting portion 430 in the upper and lower directions.

The contact portion 410 may be disposed right above the slope surface 454. The contact portion 410 may push the slope surface 454 such that the protrusion 450 moves toward the elastic member 452 away from the hole 301.

In FIG. 1, when the user pushes the operating portion 420 downwardly, the contact portion 410 may be moved downwardly by the pressed distance of the elastic part 440 and push the slope surface 454. Accordingly, the protrusion 450 may move in the direction away from the hole 301. When the protrusion 450 is ejected from the hole 301, the case 100 may be more easily rotated with respect to the frame 200 around the rotating axis A.

When the user stops pushing the operating portion 420 after rotating the case 100 with respect to the frame 200, then, the protrusion 450 may be inserted again into one of the holes 301 so that a gap (and an angle) between the case 100 and the frame 200 may be maintained.

As shown in FIG. 4, the buffer part 210 may be disposed between the frame 200 and the case 100. The buffer part 210 may include a compression spring 212, which is disposed on the frame 200, and a contacting member 211, which is disposed on the compression spring 212 and prevents the case 100 from directly contacting the compression spring 212.

If the case 100 rotates from the status in FIG. 3 (the inclined status) to the status in FIG. 2 (the vertical status), the buffer part 210 may buffer a shock that may be generated due to a collision between the case 100 and the frame 200. In addition, when the protrusion 450 is ejected from the hole 301, the buffer part 210 may provide a turning force helping rotation of the case 100.

Figure 5:
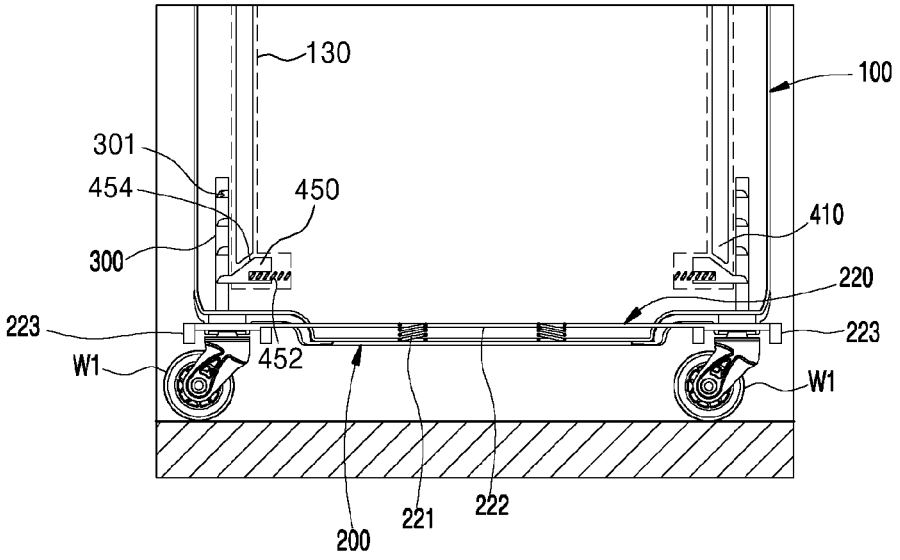
FIG. 5 is a cross-sectional view illustrating a brake of the travel bag of FIG. 1.

FIG. 5 illustrates the travel bag of FIG. 1 further including the brake disposed under the travel bag.

Referring to FIG. 5, the frame 200 may further include the brake 220 preventing the rolling of the first wheels W1. The brake 220 may include an elastic element 221 coupled onto the frame 200, a foothold 222 disposed on the elastic element 221 and receiving an upward pressure from the elastic element 221, and a friction pad 223. When the foothold 222 is downwardly pushed by an external force, the friction pad 223 may be downwardly moved along with the foothold 222 to be contact to the first wheels W1.

When the user steps on the foothold 222, the first wheels W1 may be pushed to the ground and the rolling of the first wheels W1 may be prevented by the friction pad 223. Thus, by stepping on the foothold 222 while rotating the case 100, the user can prevent the frame 200 from rotating with the case 100.

According to the present inventive concept, the travel bag 10 may include the frame 200 having a quadrilateral shape, under which the two first wheels W1 and the two second wheels W2 rolling on the ground are attached. The angle between the frame 200 and the case 100 of the travel bag 10 may be freely adjusted while the travel bag 10 is moving or stopped. Regardless of the adjusted angle, the travel bag 10 may be continuously supported by all of the wheels of the travel bag 10.

Figure 6:
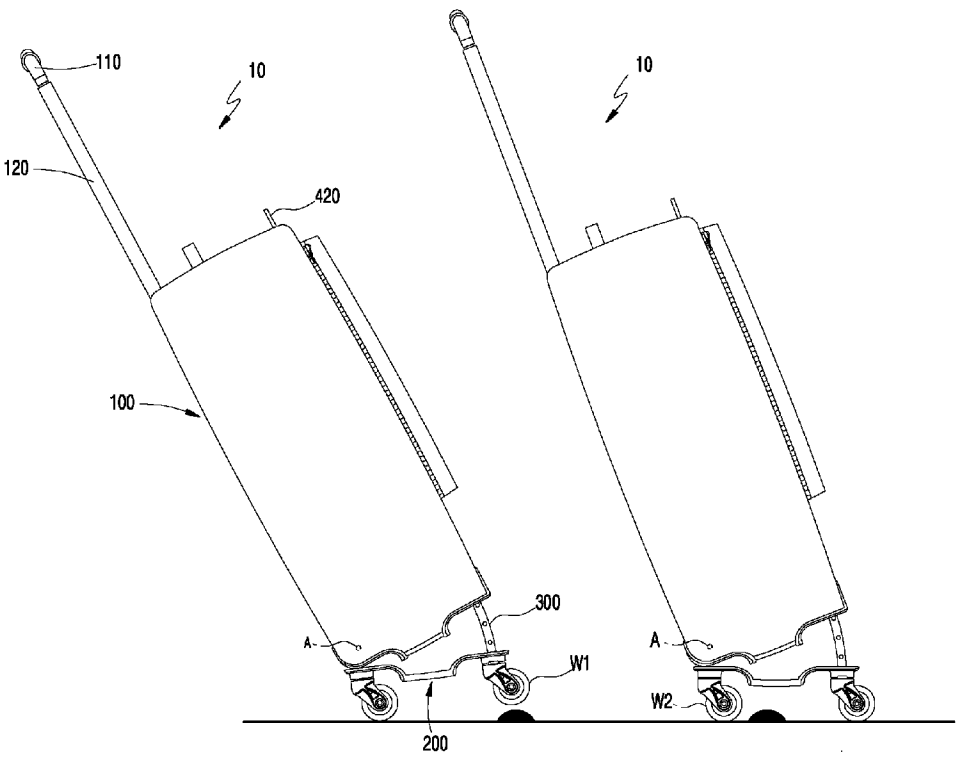
FIG. 6 illustrates a use state of the travel bag of FIG. 1.
Figure 7:
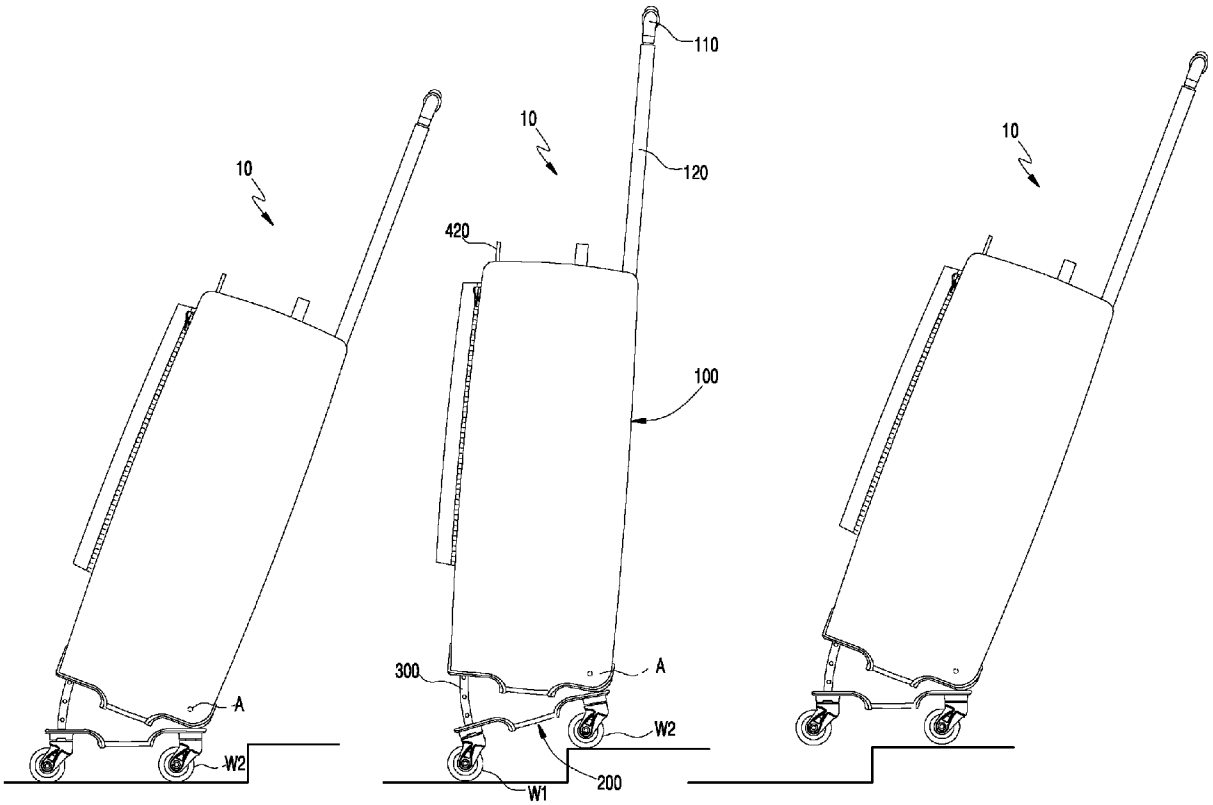
FIG. 7 illustrates a use state of the travel bag of FIG. 1.
Figure 8:
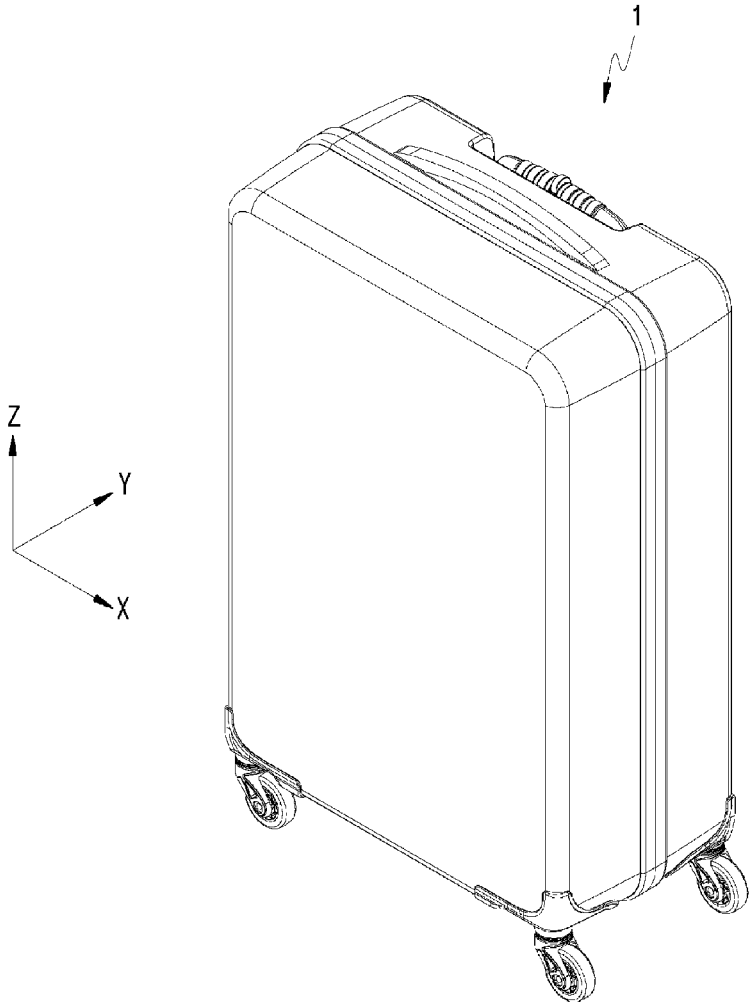
FIG. 8 is a perspective view illustrating a conventional travel bag.

FIGS. 6 and 7 illustrate use states of the travel bag of FIG. 1.

Referring to FIG. 6, the first wheels W1 and the second wheels W2 may be freely rotated 360 degrees and easily rolled even in the inclined status. The axes of the first and second wheels W1 and W2, which are perpendicular to the ground, may not be fixed, when the travel bag 10 is pushed or pulled in the inclined status. Thus, the bag 10 may not bump into lateral obstacles so that the steerability of the travel bag 10 may be enhanced. Furthermore, the stability of the travel bag 10 may be enhanced on an obstacle or at a step on the ground even though the travel bag is moved fast.

Furthermore, as shown in FIGS. 6 and 7, by adjusting the inclined angle of the travel bag 10 through the handle 110, the user may enable the travel bag 10 to easily pass a step using a leverage effect, without lifting the travel bag 10 up.

Figure 9:
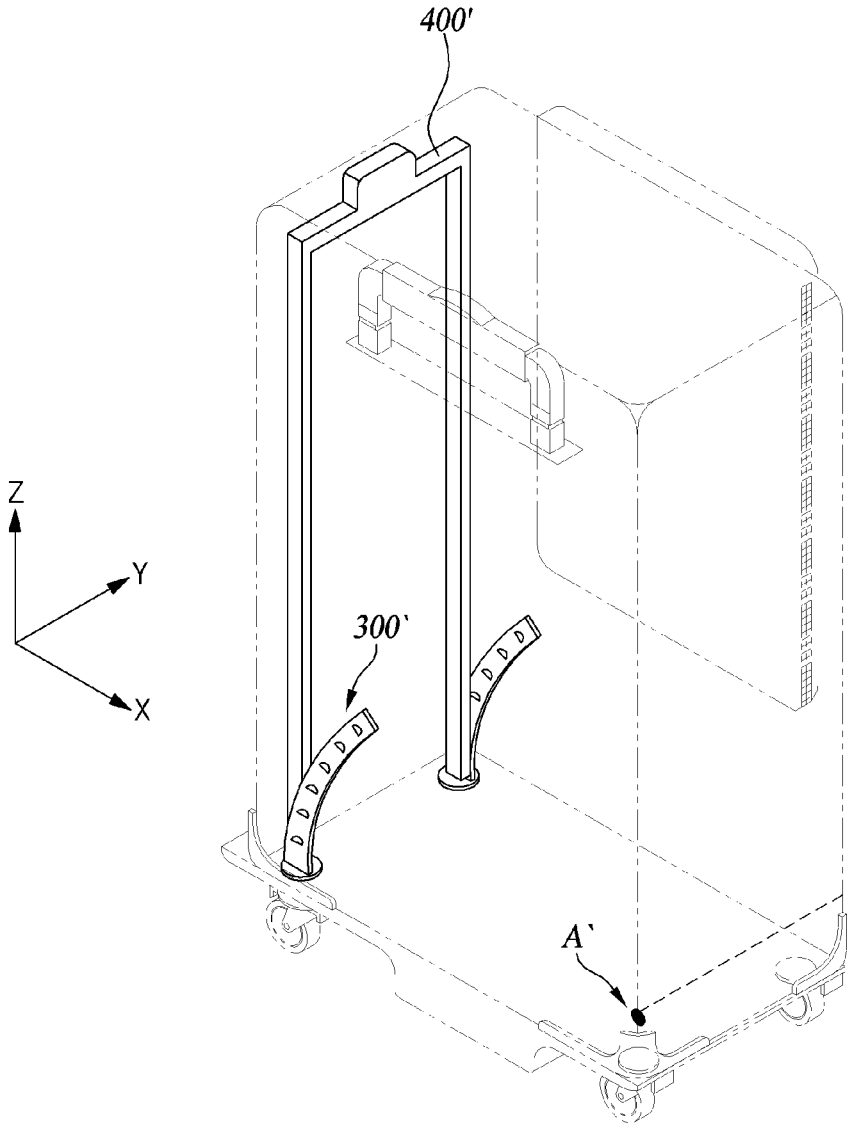
FIG. 9 illustrates a travel bag according to a second exemplary embodiment of the present inventive concept.

FIG. 9 schematically illustrates a travel bag according to a second exemplary embodiment of the present inventive concept. In FIGS. 1 to 7, the rotating axis A is disposed adjacent to a first longer side of a top surface of the frame 200 (or a lower surface of the case 100) having a generally rectangular shape and the angle maintaining units 300 are disposed at both end portions of a second longer side of the top surface facing the first longer side. Alternatively, in FIG. 9, the rotating axis A' is disposed adjacent to a first shorter side of a top surface of the frame 200 having a rectangular shape and the angle maintaining units 300' are disposed at both end portions of a second shorter side of the lower surface facing the first shorter side. Thus, according to the embodiment as shown in FIG. 9, the user may dispose the travel bag 10 at his or her lateral side, instead of the front of rear side, and move it in a direction parallel to the ground and along a direction of a longer side of the travel bag 10. The travel bag 10 may be inclined in a proper angle so that the steerability and the stability may be enhanced. For a convenience of explanation, the structure of an angle maintaining units 300' and the structure of an adjusting unit 400' are illustrated and other elements are omitted or simplified.

Figure 10:
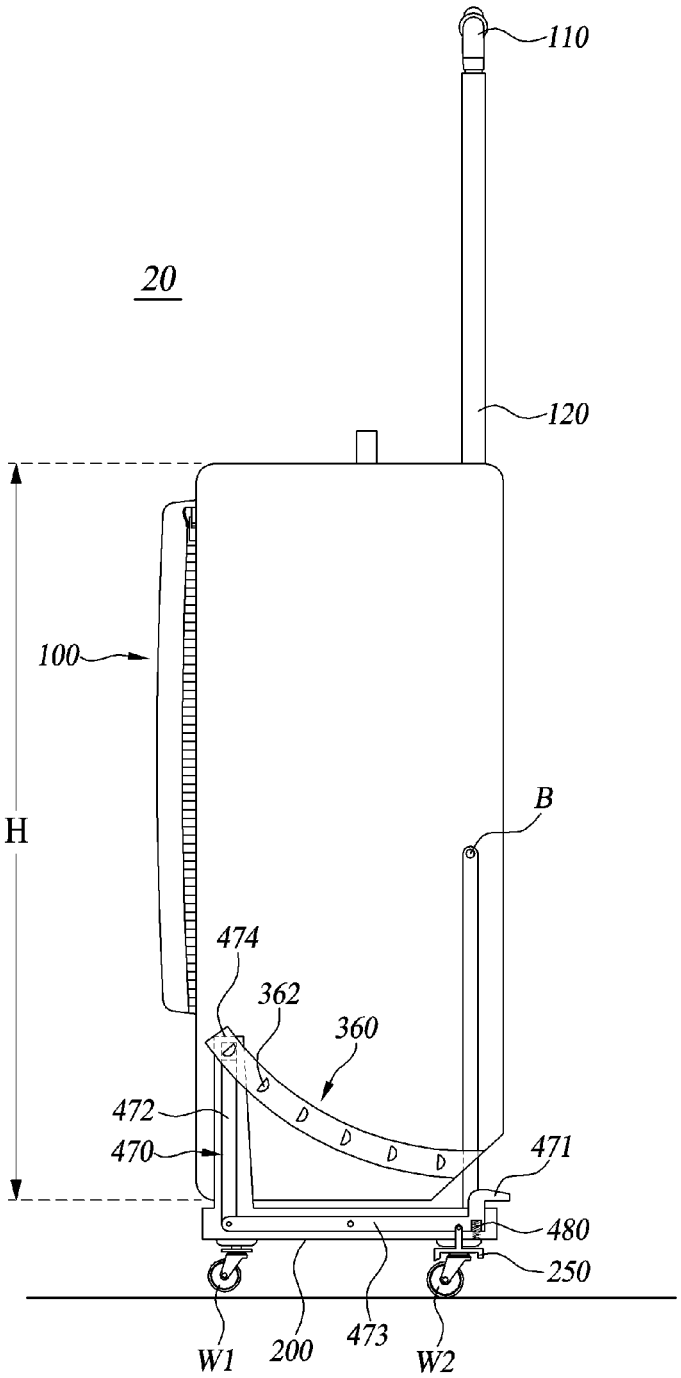
FIG. 10 illustrates a travel bag according to a third exemplary embodiment of the present inventive concept.
Figure 11:
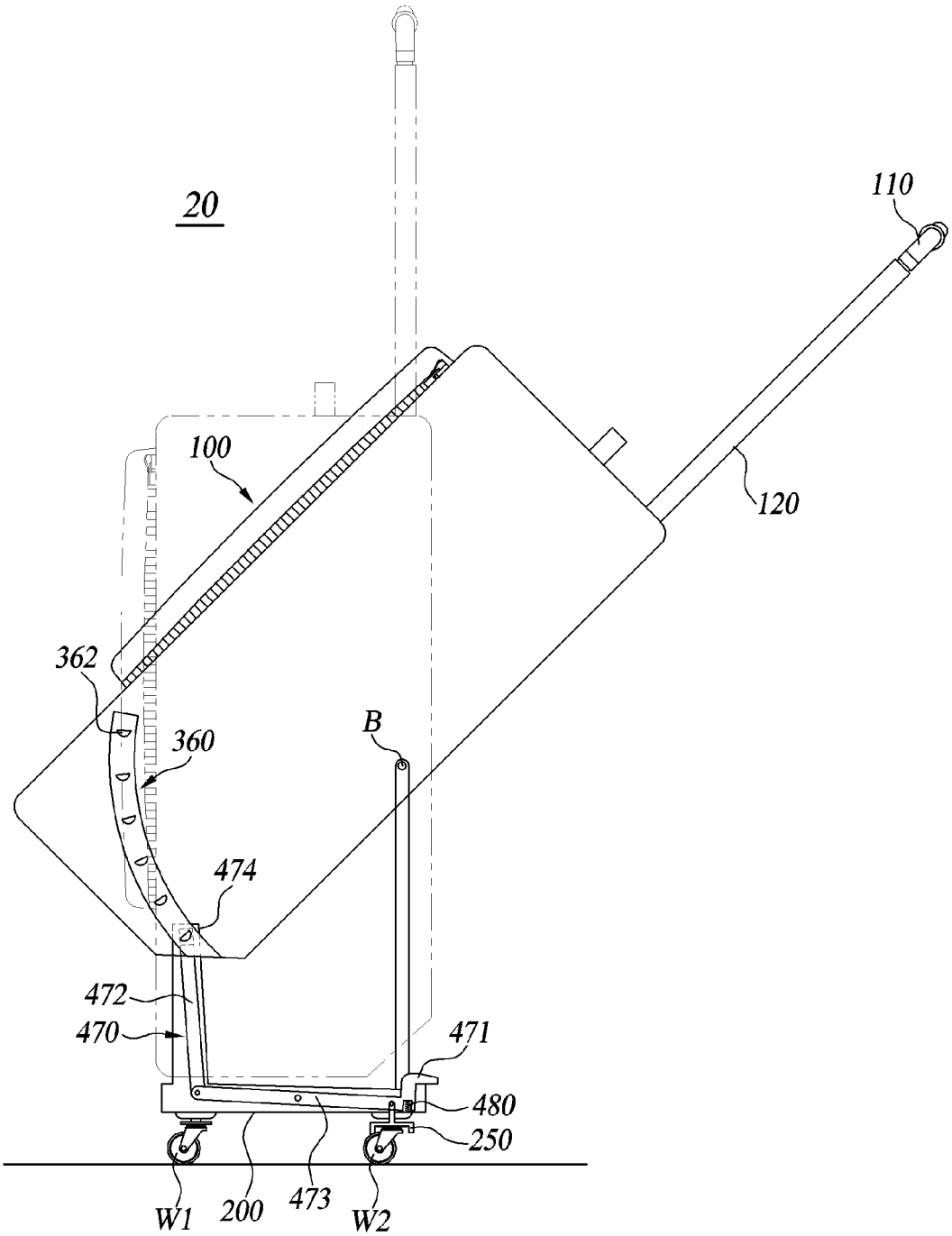
FIG. 11 illustrates a travel bag according to a third exemplary embodiment of the present inventive concept.
Figure 12:
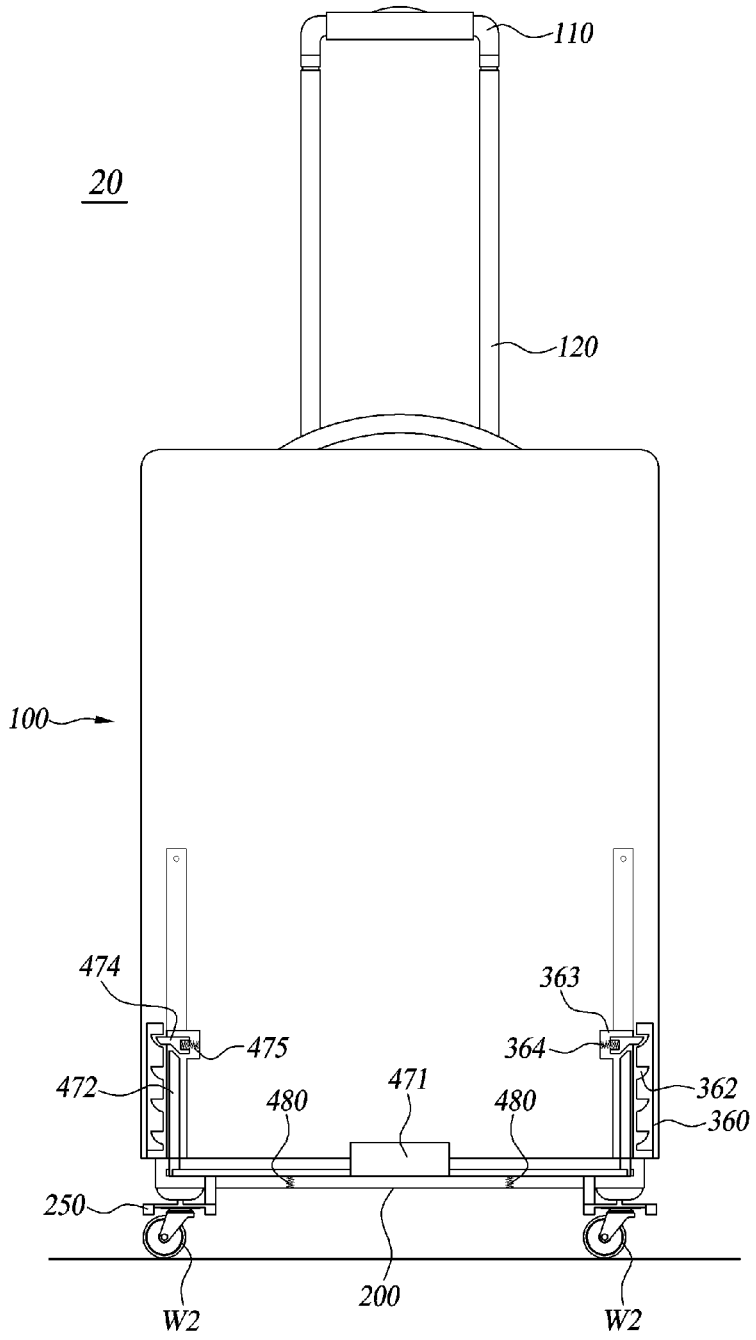
FIG. 12 illustrates a travel bag according to a third exemplary embodiment of the present inventive concept.

FIGS. 10 to 12 are cross-sectional views illustrate a travel bag 20 according to a third exemplary embodiment of the present inventive concept.

Referring to FIGS. 10 to 12, in the travel bag 20 according to the third exemplary embodiment, a case 100 may be rotatably coupled to the frame 200 around a rotating axis B located above the second wheels W2, similarly to the travel bag 10 according to the previous exemplary embodiments explained referring to FIGS. 1 to 7.

However, the rotating axis B of the travel bag 20 according to the present exemplary embodiment may be disposed higher than the rotating axis A of the travel bag 10 according to the previous first exemplary embodiment. Thus, according to the present exemplary embodiment, the angle between the height direction and the plane defined by the wheels, in the present third embodiment may be larger than that of the first or second exemplary embodiments, when the case 100 rotates with respect to the ground around the rotating axis B. Unlike the travel bag 10 of the previous first exemplary embodiment, the angle maintaining units 360 may be disposed at inner side surfaces of the case 100 and adjusting units 470 may be coupled to the frame 200.

Hereinafter, structural differences of the travel bag 20 according to the third exemplary embodiment are mainly explained. The same reference numerals will be used to refer to the same or similar parts such as a case 100, a frame 200, a handle 110, a bar 120, a first wheel W1 and a second wheel W2 as those described in the previous exemplary embodiment of FIGS. 1 to 7 and the same parts are explained by the same words for convenience of explanation.

As explained above, the case 100 may be coupled to the frame 200 rotatably around the rotating axis B. The rotating axis B may be disposed above the second wheels W2 such that when the case 100 is rotated with respect to the frame 200, a center of gravity of the travel bag 20 does not deviate from a region defined above the frame 200. Thus, even when moving the travel bag 20 in the inclined status, the travel bag 20 may not fall down even though the user does not hold the travel bag 20, and a heavy weight is prevented from being applied to a hand of the user. The rotating axis B may be disposed relatively higher position from the ground (at least higher than the position of the rotating axis A of the case 100 in FIG. 2). For example, the rotating axis B may be disposed at around a half of a height H of the case 100. In an exemplary embodiment, the position of the rotating axis B may be properly determined as long as the center of gravity of the travel bag 20 does not deviate from a region defined by four wheels. As discussed above, the position of the rotating axis B may be determined so that the travel bag 20 may not fall down when the case 100 is rotated with respect to the frame 200 and a force to rotate the case 100 with respect to the frame 200 is not excessive.

The angle maintaining units 360 may maintain an increased angle between the height direction of the case 100 and a plane defined by the first wheels W1 and the second wheels W2 after the case 100 is rotated. The angle maintaining units 360 may have a shape of an arc of a circle. A center of the circle is the rotating axis B. The angle maintaining units 360 may be disposed at both of inner surfaces of the case 100. As shown in FIG. 10, in vertical status, a height direction of the case is perpendicular to the ground, and the height direction is allowed to be inclined according to the case's pivoting around the pivot axis B so that an angle between the height direction and a plane defined by the wheels is allowed to vary The angle maintaining unit 360 may include a plurality of holes 362. The plurality of the holes 362 may be spaced apart from one another along a longitudinal direction of the angle maintaining unit 360.

A protrusion 474 of the adjusting unit 470 may be inserted into the hole 362 to maintain the rotated status of the case 100 with respect to the frame 200. The protrusion 474 may be partially covered and partially hidden by the angle maintaining unit 360 in FIGS. 10 and 11. The protrusion 474 may be disposed over the first wheel W1 and coupled to the frame 200.

The protrusion 474 may receive a pressure toward the angle maintaining unit 360 by an elastic member 475 of FIG. 12. When the protrusion 474 is inserted into the hole 362 and an external force is not applied to the protrusion 474, the rotated status of the case 100 with respect to the frame 200 may be stably maintained. The protrusion 474 may be ejected from the hole 362 by the external force in a direction opposite to an elastic force of the elastic member 475 so that the case 100 may become a rotatable status with respect to the frame 200.

The protrusion 474 may have an slope surface. The slope surface of the protrusion 474 may receive a pressure in a direction opposite to the elastic force of the elastic member 475 by a contact portion 472. The hole 362 may have be a recess space having a shape of a portion of hollow hemisphere, which is open in the direction toward the protrusion 474. A curved portion of the hole 362 may be disposed at a lower position, but the present inventive concept is not limited thereto. The shape of the recess space of the hole 362 may correspond to a shape of an end portion of the protrusion 474 so that the end portion of the protrusion 474 may be inserted and fit into the hole 362.

When the case 100 is rotated around the rotating axis B while the first wheels W1 and the second wheels W2 being maintained to be contact to the ground, as shown in FIG. 11, the case 100 and the angle maintaining units 360 located on the case 100 may be rotated along the arc of the circle having the center of the rotating axis B. The protrusion 474 may be inserted in one of the holes 362 when the case 100 is rotated around the rotating axis B. After the protrusion 474 is inserted in one of the holes 362, the case 100 may stop the rotation and may maintain the status.

In the present third exemplary embodiment, an operation of a friction pad 250 may be interlocked with an operation of the adjusting unit 470. Hereinafter, the structure and the operation of the adjusting unit 470, which operates to allow the protrusion 474 to be ejected from the hole 362, and the structure and the operation of the friction pad 250, which operates to fix the wheels while the case 100 is being rotated, are explained.

The adjusting unit 470 includes an operating portion 471 to be operated by the user, the contact portion 472 to press the protrusion 474, a connecting portion 473 to connect the operating portion 471 and the contact portion 472, the protrusion 474, and the elastic member 475. In an exemplary embodiment, the adjusting unit 470 may be disposed within the frame 200. The contact portion 472 of the adjusting unit 470 may be disposed to be spaced apart from a side wall of the frame 200 inside the frame 200 such that the operation of the adjusting unit 470 may not be restricted by the frame wall. The operating portion 471 may be disposed above the second wheels W2. The contact portion 472 may extend from a portion above the first wheel W1 toward the protrusion 474 in a vertical direction.

In the present third exemplary embodiment, the angle maintaining units 360 may be disposed at both inner surfaces of the case 100 facing each other. In the present third exemplary embodiment, a portion of the adjusting unit 470 (e.g. the contact portion 472) and a portion of the frame 200 corresponding thereto may enter or exit from a certain space disposed at both inner sides of the case 100, which correspond to the angle maintaining unit 360.

When all of the wheels of the travel bag 20 are contact to the ground, if the operating portion 471 is pressed downwardly by a user, an end portion of the contact portion 472 is shifted in an upper direction by a leverage effect so that the contact portion 472 pushes the slope surface of the protrusion 474. When the slope surface of the protrusion 474 is pressed, the protrusion 474 is ejected from the hole 362 so that the case 100 may become a rotatable status in the rotating axis B.

The adjusting unit 470 may receive an elastic force in an upward direction toward the case 100 by an elastic part 480. Without an external force applied to the operating portion 471, the contact portion 472 is spaced apart from the protrusion 474 and does not press the slope surface of the protrusion 474.

In an exemplary embodiment, the elastic part 480 is disposed between the connecting portion 473 and a portion of the frame 200 disposed under the connecting portion 473. The elastic part 480 may provide the elastic force to the connecting portion 473 in an upper direction. For example, the elastic part 480 may be disposed closer to the second wheel W2 than the first wheel W1.

When the operating portion 471 is pressed, a portion of the connecting portion 473 adjacent to the second wheel W2 is pressed toward a back surface of the frame 200 and a portion of the connecting portion 473 adjacent to the first wheel W1 is moved in an upper direction so that the contact portion 472 may press the protrusion 474. When a pressing force applied to the operating portion 471 is removed, the connecting portion 473 is returned to an original position by the elastic part 480 and the contact portion 472 does not press the protrusion 474.

The friction pad 250 may be disposed adjacent to the second wheel W2. The friction pad 250 may be contact to the second wheel W2 and prevents the rolling of the second wheel W2. Although not shown in figures in detail, the friction pad 250 may have a circular shape to surround an outer surface of the second wheel W2. The friction pad 250 may be coupled to a portion of the adjusting unit 470 adjacent to the second wheel W2. In an exemplary embodiment, the friction pad 250 may be coupled to the connecting portion 473 of the adjusting unit 470 disposed over the second wheel W2.

The friction pad 250 may be maintained to be spaced apart from the second wheel W2, without an external force. When the operating portion 471 is pressed, the friction pad 250 may access and make contact to the second wheel W2 so as to constraint the second wheel W2 from moving by the friction force generated between the friction pad 250 and the second wheel W2. Since the second wheel W2 is fixed by the friction pad 250, the frame 200 may not rotate with the case 100 when the case 100 is rotated. Since the frame 200 does not rotate with the case 100 when the case 100 is rotated, the user may stably rotate the case 100 around the rotating axis B.

According to the travel bag 20 of the third exemplary embodiment, the rotating axis is disposed at a higher position and thus, the case 100 may rotate with respect to the frame 200 at a larger angle. However, the center of gravity of the travel bag 20 does not deviate from an area over a region defined by four wheels, even when the travel bag 20 rotate to form a relatively great angle, the travel bag 20 may not fall down and the rotating status thereof may be stably maintained. Furthermore, the operation of the friction pad 250 to prevent the rolling of the second wheel W2 may be interlocked with the rotation of the case 100 so that the case 100 may be stably rotated without an additional operation of the friction pad 250.

Figure 13:
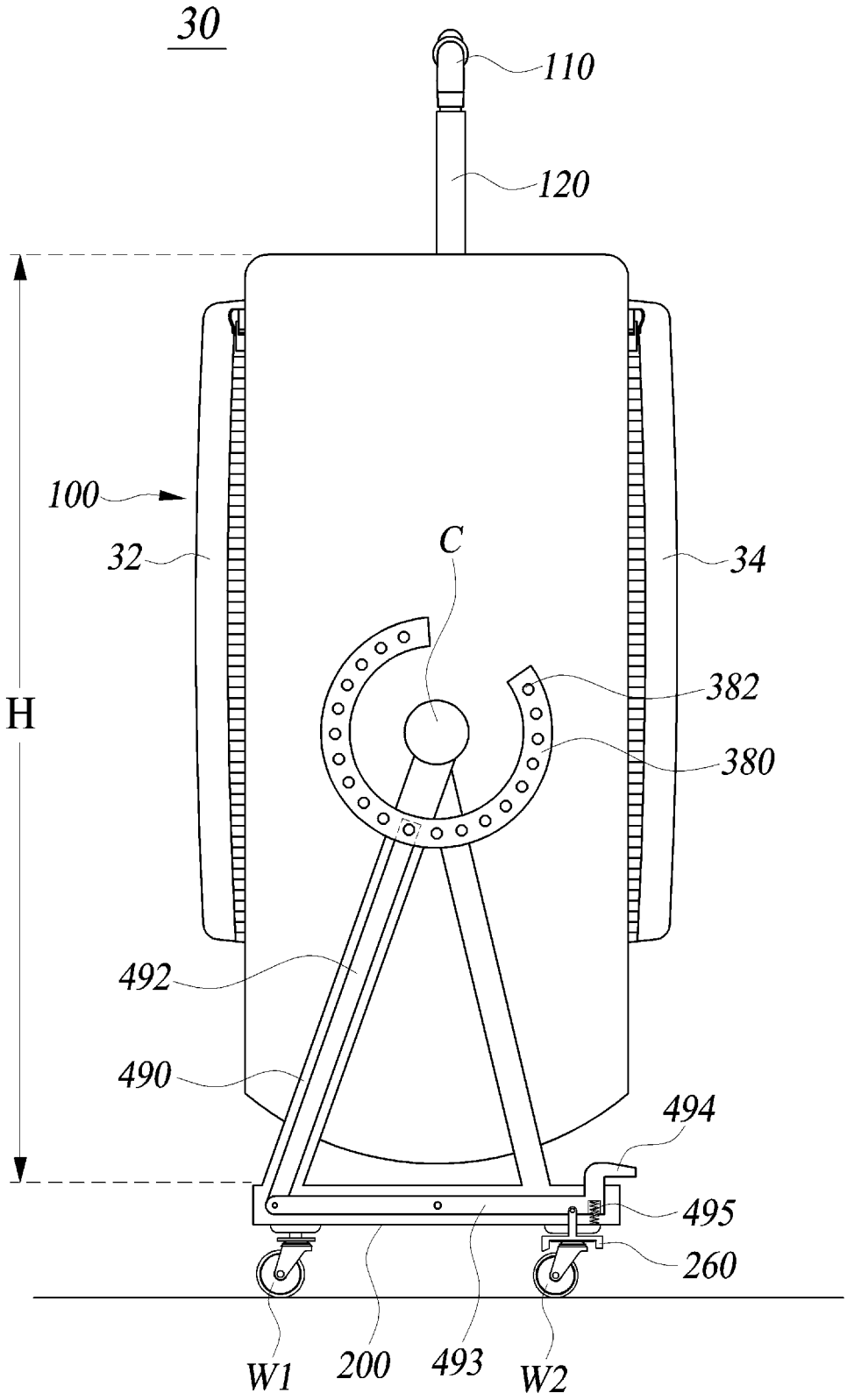
FIG. 13 illustrates a travel bag according to a fourth exemplary embodiment of the present inventive concept.

FIG. 13 is a cross-sectional view illustrating a travel bag 30 according to a fourth exemplary embodiment of the present inventive concept. For convenience of explanation, FIG. 13 illustrates some of the elements disposed within the case 100 entirely although they may not be entirely or partially exposed outwardly. A practical exterior of the travel bag 30 according to the fourth exemplary embodiment may be different from that in FIG. 13.

In the travel bag 30 according to the fourth exemplary embodiment, a case 100 may be rotatably coupled to the frame 200, similarly to the travel bags 10 and 20 according to the previous exemplary embodiments explained referring to FIGS. 1 to 12. In FIG. 13, the same reference numerals will be used to refer to the same or like parts of the travel bags 10 and 20 such as a case 100, a frame 200, a handle 110, a bar 120, a first wheel W1 and a second wheel W2 as those described in the previous exemplary embodiment of FIGS. 1 to 12. Hereinafter, structural differences of the travel bag 30 according to the fourth exemplary embodiment from the travel bags 10 and 20 according to the previous exemplary embodiments are mainly explained.

Unlike the case 100 of the travel bags 10 and 20 of the previous exemplary embodiments, the case 100 of the travel bag 30 includes two windows 32 and 34. The travel bag 30 may be opened and closed by the windows 32 and 34. In addition, the handle 110 and the bar 120 of the travel bag 30 may be disposed adjacent to a central portion of an upper surface of the case 100 of the travel bag 30, instead of an edge portion of the upper surface of the case 100 of the travel bag 30. A bottom surface of the case 100 of the travel bag 30 may have a shape of a portion of a globe, whose center may be located at a center axis C to be discussed below. The bottom surface of the case 100 may be formed not to bump into the frame 200 when the case 100 is rotated around the center axis C.

As shown in FIG. 13, the angle maintaining units 380 may be respectively disposed at a central portion of each of both inner side surfaces of the case 100 to surround the rotating center axis C. The angle maintaining unit 380 may have a shape of an arc or a circle. The angle maintaining unit 380 may include a plurality of holes 382. The plurality of the holes 382 may be disposed along the arc of the angle maintaining unit 380. The hole 382 may be an opening, which is open in a direction toward an adjusting unit 490.

The travel bag 30 may include the adjusting unit 490 coupled to the frame 200. In an exemplary embodiment, the adjusting unit 490 may be disposed within the frame 200. A contact portion 492 of the adjusting unit 490 may be spaced apart from a side wall of the frame 200 inside the frame 200 such that the operation of the adjusting unit 490 may not be limited by the frame wall. An operating portion 494 and a contact portion 492 may be connected by a connecting portion 493. A length of the connecting portion 493 of the travel bag 30 may be less than a length of the contact portion 492 of the travel bag 30 (However, the present inventive concept is not limited thereto). The operating portion 494 may be disposed above the second wheel W2. The contact portion 492 may extend from a portion adjacent to the first wheel W1 to the central portion (the center axis C) of the inner side surface of the case 100.

The adjusting unit 490 (and a corresponding portion of the frame 200) may be received at a certain space disposed within the case 100. For example, the adjusting unit 490 may be received at the certain space in the case 100, which is inner than the inner side surface of the case 100 at which the angle maintaining unit 380 is disposed. The adjusting unit 490 and the corresponding frame 200 may enter and exit from the certain space according to the rotation of the case 100. The adjusting unit 490 may include a protrusion, which is hidden by the angle maintaining unit 380 and thus not shown in FIG. 13 but is indicated as reference numeral 491 in FIG. 14. The protrusion 491 may have a tip having a portion of a part of convex hemisphere or a cylinder, The end portion of the protrusion 491 may be inserted into the hole 382 of the angle maintaining unit 380. The hole 382 may have a shape corresponding to the end portion of the protrusion 491.

The case 100 may rotate around the rotating center axis C, while maintaining the first wheels W1 and the second wheels W2 to be contact to the ground. When the case 100 is rotated around the rotating center axis C, the angle maintaining unit 380 is also rotated along with the rotation of the case 100. The user may stop pressing the operating portion 494 when the case is rotated to a desired angle. Then, the case may rotate a little more and be stopped and then, the protrusion 491 may be inserted into one of the closest holes 382. After the protrusion 491 is inserted in one of the holes 382, the case 100 may not be rotatable and may maintain the status.

When all of the wheels of the travel bag 30 are contact to the ground, if the operating portion 494 is pressed downwardly by a user, an end portion of the contact portion 492 is shifted in an upper direction by a leverage effect so that the contact portion 492 pushes a slope surface of the protrusion 491. When the slope surface of the protrusion 491 is pressed, the protrusion 491 is ejected from the hole 382 so that the case 100 may become a rotatable status in the center axis C.

The adjusting unit 490 may receive an elastic force in a direction toward the case 100 by an elastic part 495. Without an external force applied to the operating portion 494, the contact portion 492 is spaced apart from the protrusion 491 and does not press the slope surface of the protrusion 491.

When the operating portion 494 is pressed, a portion of the connecting portion 493 adjacent to the second wheel W2 is pressed toward a back surface of the frame 200 and a portion of the connecting portion 473 far from the second wheel W2 (e.g. adjacent to the first wheel W1) is moved in an upper direction so that the contact portion 492 may press the protrusion 491. When a pressing force applied to the operating portion 494 is removed, the connecting portion 493 is returned to an original position by the elastic part 495 and the contact portion 492 does not press the protrusion 491.

Figure 14:
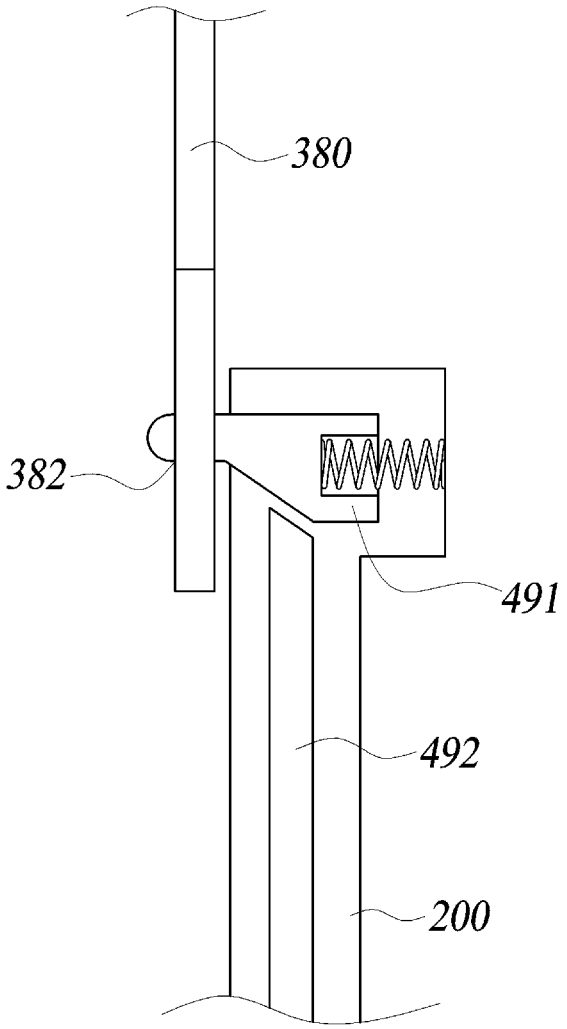
FIG. 14 illustrates a travel bag according to a fourth exemplary embodiment of the present inventive concept.

FIG. 14 illustrates the structure of the angle maintaining unit 380, the contact portion 492 of the adjusting unit 490 and the protrusion 491 of the travel bag 30 according to the fourth exemplary embodiment of the present inventive concept. Referring to FIG. 14, insertion structure of the protrusion 491 of the adjusting unit 490 into the hole 382 of the angle maintaining unit 380 may be clearly illustrated.

In the present exemplary embodiment, the friction pad 260 may be disposed adjacent to the second wheel W2. The friction pad 260 may be contact to the second wheel W2 and prevents the rolling of the second wheel W2. Although not shown in figures in detail, the friction pad 260 may have a circular shape such that a portion of an upper surface of the second wheel W2 is pressed in any status of the second wheel W2. The friction pad 260 may be coupled to a portion of the adjusting unit 490 adjacent to the second wheel W2. In an exemplary embodiment, the friction pad 260 may be coupled to the connecting portion 493 disposed over the second wheel W2. The structure and the operation of the friction pad 260 of the travel bag 30 according to the present exemplary embodiment may be substantially same as the structure and the operation of the friction pad 250 of the travel bag 20 according to the previous exemplary embodiment.

In the travel bag 30 shown in FIGS. 13 and 14, the central axis C of the rotation of the case 100 may be disposed at a central portion of the case 100 so that the case 100 may be inclined in various angles. Thus, the center of gravity of the travel bag 30 does not deviate from an area over a region defined by four wheels, which support the travel bag 30 on the ground, even in the inclined status of the case 100. Accordingly, when the travel bag 30 is moving and stopped in the inclined status of the case 100, a weight of the travel bag 30 may not be transmitted to the user. Therefore, although the user uses the travel bag 30 for a long time, a hand or a shoulder of the user may not be hurt.

When the user uses the travel bag, the user sometimes should open the travel bag to find an object therein (e.g. to find a portable electric battery at a check-in counter in an airport). In this situation, when using a conventional travel bag, a lot of objects in the travel bag may be dropped unintentionally if the user tries to find the desired object in the vertical status of the travel bag. In such case, the user may put the travel bag on the ground and squat down or bend a waist to find the object.

According to the present exemplary embodiment, the case 100 of the travel bag 30 in FIGS. 13 and 14 may be rotatable in various angles. The case 100 may be fixed in a horizontal status, in which the case 100 is disposed to be parallel to the ground and in a relatively high position. Thus, an outer surface of the case 100 may be prevented from being dirty or damaged. In addition, the case 100 is rotated with respect to the frame and fixed in the horizontal status so that the user may conveniently find the desired object. Since the travel bag 30 may include the window 32 and 34 in both sides, the case 100 may be selectively rotated in both directions to easily find the object. The user may conveniently find and take the desired object out of the travel bag 30 by any of two-sided windows 32 and 34 without unpacking.

The travel bag 30 according to the present exemplary embodiment explained referring to FIGS. 13 and 14 is substantially the same as the travel bag 10 and 20 of the previous exemplary embodiment explained referring to FIGS. 1 to 12, except for the position of the rotating axis C, the position of the contact portion 492 and the inclined angle of the case.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A travel bag comprising:

a frame having at least three wheels attached to the frame, each of the wheels being configured to be contacted to a ground;

a case being configured to have an empty space to receive objects and configured to be disposed on the frame; and a pivot axis being located on or above the frame, the pivot axis being defined by two contact points or a contact line connecting the case and the frame, wherein the case disposed on the frame is configured to pivot on the pivot axis to draw a trajectory of an arc or a circle, and wherein all of the wheels are configured to be maintained as being continuously contact to the ground, regardless of the case's pivoting around the pivot axis, wherein the case has a height direction that is disposed perpendicular to the ground when the case is in a vertical status, and wherein the height direction is allowed to be inclined according to the case's pivoting around the pivot axis so that an angle between the height direction and a plane defined by the wheels is allowed to vary, wherein the travel bag further comprises an angle maintaining unit configured to maintain the varied angle between the height direction and the plane, after the case's pivoting around the pivot axis, wherein the angle maintaining unit has a shape of an arc or a circle whose center is a rotating axis, and wherein the angle maintaining unit has a plurality of recesses or holes formed thereon, each of the recesses having a shape of a part of hollow hemisphere or each of the holes having a shape of hollow cylinder, wherein the travel bag further comprises an adjusting unit, and the adjusting unit comprises:

a protrusion including a tip having a portion of a part of convex hemisphere or a cylinder, the tip being configured to be inserted into a recess or a hole among the plurality of recesses or holes according to the case's pivoting around the pivot axis; and a contact portion configured to be operated either to maintain the tip as being inserted into the recess or hole or to push the tip to be slid out in a direction away from the recess or hole, and wherein the protrusion is disposed at the case, and wherein the angle maintaining unit is coupled to the frame.

2. The travel bag of claim 1, wherein the adjusting unit further comprises an elastic member configured to press the protrusion toward the angle maintaining unit.

3. The travel bag of claim 1, further comprising a brake disposed at the frame and configured to prevent a rolling of at least one of the wheels, wherein the brake comprises:

an elastic element coupled to the frame;

a foothold configured to be pressed by the elastic element in an upper direction; and a friction pad configured to make contact to the at least one wheel when the foothold is pressed in a lower direction.

4. The travel bag of claim 1, wherein the case includes a pair of sides facing each other, and wherein an openable part is disposed on each of the sides.

5. A travel bag comprising:

a frame having at least three wheels attached to the frame, each of the wheels being configured to be contacted to a ground;

a case being configured to have an empty space to receive objects and configured to be disposed on the frame; and a pivot axis being located on or above the frame, the pivot axis being defined by two contact points or a contact line connecting the case and the frame, wherein the case disposed on the frame is configured to pivot on the pivot axis to draw a trajectory of an arc or a circle, wherein all of the wheels are configured to be maintained as being continuously contact to the ground, regardless of the case's pivoting around the pivot axis, wherein the case has a height direction that is disposed perpendicular to the ground when the case is in a vertical status, and wherein the height direction is allowed to be inclined according to the case's pivoting around the pivot axis so that an angle between the height direction and a plane defined by the wheels is allowed to vary, wherein the travel bag further comprises an angle maintaining unit configured to maintain the varied angle between the height direction and the plane, after the case's pivoting around the pivot axis, wherein the angle maintaining unit has a shape of an arc or a circle whose center is a rotating axis, and wherein the angle maintaining unit has a plurality of recesses or holes formed thereon, each of the recesses having a shape of a part of hollow hemisphere or each of the holes having a shape of hollow cylinder, wherein the travel bag further comprises an adjusting unit, and the adjusting unit comprises:

a protrusion including a tip having a portion of a part of convex hemisphere or a cylinder, the tip being configured to be inserted into a recess or a hole among the plurality of recesses or holes according to the case's pivoting around the pivot axis; and a contact portion configured to be operated either to maintain the tip as being inserted into the recess or hole or to push the tip to be slid out in a direction away from the recess or hole, wherein the protrusion includes a slope surface that is inclined with respect to a direction of a pressure of an elastic member, wherein the adjusting unit comprises:

an operating portion configured to be operated by a user; and an elastic part configured to push the operating portion in a direction that makes the contact portion be located apart from the slope surface of the protrusion, and wherein, when the user applies a force to the operating portion, the elastic part is pressed so that the contact portion pushes the slope surface of the protrusion.

6. The travel bag of claim 5, wherein the adjusting unit further comprises a connecting portion connecting the operating portion and the contact portion, and wherein, when the user applies a force to the operating portion downwardly, at least a part of the force is transferred to the connecting portion to cause a leverage effect that makes the contact portion push the slope surface of the protrusion.

7. The travel bag of claim 5, further comprising a friction pad configured to make contact to at least one of the wheels to prevent a rolling of the at least one wheel, wherein, when the user applies a force to a foothold, the friction pad moves to make contact to the at least one wheel.

* * * * *